US009278258B2

(12) United States Patent
Kisilevich

(10) Patent No.: US 9,278,258 B2
(45) Date of Patent: Mar. 8, 2016

(54) DUAL RESISTANCE AMBIDEXTROUS AQUATIC HAND COVERING

(71) Applicant: Susan Kisilevich, Edmonton (CA)

(72) Inventor: Susan Kisilevich, Edmonton (CA)

( * ) Notice: Subject to any disclaimer, the term of this patent is extended or adjusted under 35 U.S.C. 154(b) by 0 days.

(21) Appl. No.: 14/300,330

(22) Filed: Jun. 10, 2014

(65) Prior Publication Data

US 2015/0352408 A1 Dec. 10, 2015

(30) Foreign Application Priority Data

Jun. 4, 2014 (CA) ..... 2853368

(51) Int. Cl.
*A63B 31/10* (2006.01)
*A63B 31/02* (2006.01)

(52) U.S. Cl.
CPC ..... *A63B 31/10* (2013.01); *A63B 31/02* (2013.01)

(58) Field of Classification Search
CPC ..... A63B 31/00; A63B 31/04; A41D 19/00; A41D 19/02
USPC ..... 441/57; 2/159, 161, 162, 163
See application file for complete search history.

(56) References Cited

U.S. PATENT DOCUMENTS 1,185,411 A * 5/1916 Kennard ..... 441/57
1,740,290 A * 12/1929 Feketis ..... 441/57
3,257,673 A 6/1966 Rademacher
4,195,365 A * 4/1980 Eyman et al. ..... 441/57
5,820,526 A 10/1998 Hoffman
5,839,122 A 11/1998 Dicker et al.
5,984,840 A 11/1999 Awbrey et al.
6,962,553 B2 11/2005 Stout et al.
7,237,273 B2 7/2007 Hernandez
7,255,619 B2 8/2007 Rasmussen
2008/0161171 A1 7/2008 Wise
2008/0242168 A1 10/2008 Wang
2013/0052894 A1 2/2013 Grainger et al.

OTHER PUBLICATIONS

Lifeguard website, Wave Web Pro Gloves, url: http://www.thelifeguardstore.com/productcart/pc/Wave-Web-Pro-Gloves-p3435.htm, retrieved Feb. 26, 2014. 2 Pages.

* cited by examiner

*Primary Examiner* — Lars A Olson
(74) *Attorney, Agent, or Firm* — Davis & Bujold PLLC; Michael J. Bujold

(57) ABSTRACT

There is provided a hand covering for a person for use in water based exercise having a body having a first side and a second side that are attached along an outer edge to define a hand-receiving cavity and an opening in communication with the hand-receiving cavity. The hand-receiving cavity is sized and shaped to permit the body to be worn on a left hand in a first orientation and on a right hand in a second orientation that is opposite the first orientation, and the first side has a first permeability and the second side has a second permeability that is different from the first permeability.

8 Claims, 6 Drawing Sheets

DUAL RESISTANCE AMBIDEXTROUS AQUATIC HAND COVERING

TECHNICAL FIELD

This relates to an article of clothing that preferably covers the hand and is used for water based exercises.

BACKGROUND

Aquatic exercise is recommended for many people, including those who are recovering from injuries or have limited mobility. In order to build strength for these individuals and others, water based exercises can be performed at varying difficulty levels, including the type of exercise and the degree of resistance that an individual experiences during movement through the water.

SUMMARY

According to an aspect, there is provided a hand covering for a person for use in water based exercise having a body having a first side and a second side that are attached along an outer edge to define a hand-receiving cavity and an opening in communication with the hand-receiving cavity, the hand-receiving cavity being sized and shaped to permit the body to be worn on a left hand in a first orientation and on a right hand in a second orientation that is opposite the first orientation; the first side having a first permeability and the second side having a second permeability that is different from the first permeability.

According to another aspect, the shapes of the first and second sides may comprise mirror images.

According to another aspect, the hand covering may be a hag that can be worn in the first and second orientations on each of the left and right hands, a mitt, or a glove having webbed fingers.

According to another aspect, at least one of the first sides and the second sides may comprise a mesh fabric.

According to an aspect, there is provided a method of providing variable resistance to a user during water based exercises having the steps of providing a hand covering for a person comprising a body having a first side and a second side that are attached along an outer edge to define a hand-receiving cavity and an opening in communication with the hand-receiving cavity, the hand-receiving cavity being sized and shaped to permit the body to be worn on a left hand in a first orientation and on a right hand in a second orientation that is opposite the first orientation; the first side having a first permeability and the second side having a second permeability that is different from the first permeability; inducing a first drag by moving the hand covering through the water with the first side leading and inducing a second drag that is different from the first drag by moving the hand covering through the water with the second side leading.

According to another aspect, the shapes of the first and second sides may be mirror images.

According to another aspect, moving the gloves to the opposite hands may result in reversing the orientations of the gloves and thereby switch the induced drag.

According to another aspect, the hand covering may be a bag that can be worn in the first and second orientations on each of the left and right hands, a mitt, or a glove having webbed fingers.

According to another aspect, at least one of the first sides and the second sides comprises a mesh fabric.

According to another aspect, providing a hand covering may comprise providing a first hand covering on a right hand and a second hand covering on a left hand, wherein the first hand covering is in the first orientation and a second hand covering is in the second orientation.

According to an aspect, there is provided an article of clothing for water based exercise, the article of clothing having a first side with a first material having a first permeability and a second side with a second material having a second permeability that is different from the first, the article of clothing inducing a first drag when the first side leads through the water and a second drag that is different from the first when the second side leads through the water. The shapes of the first and second sides are mirror images such that the article can be worn by a user in a first orientation and a second orientation that is opposite the first orientation.

According to another aspect, the article of clothing may cover a hand of a person.

According to another aspect, the hand covering may be a bag that can be worn in the first and second orientations on each of the left and right hands, a mitt, or a glove having webbed fingers.

According to another aspect, at least one of the first material and the second material may be a mesh fabric.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
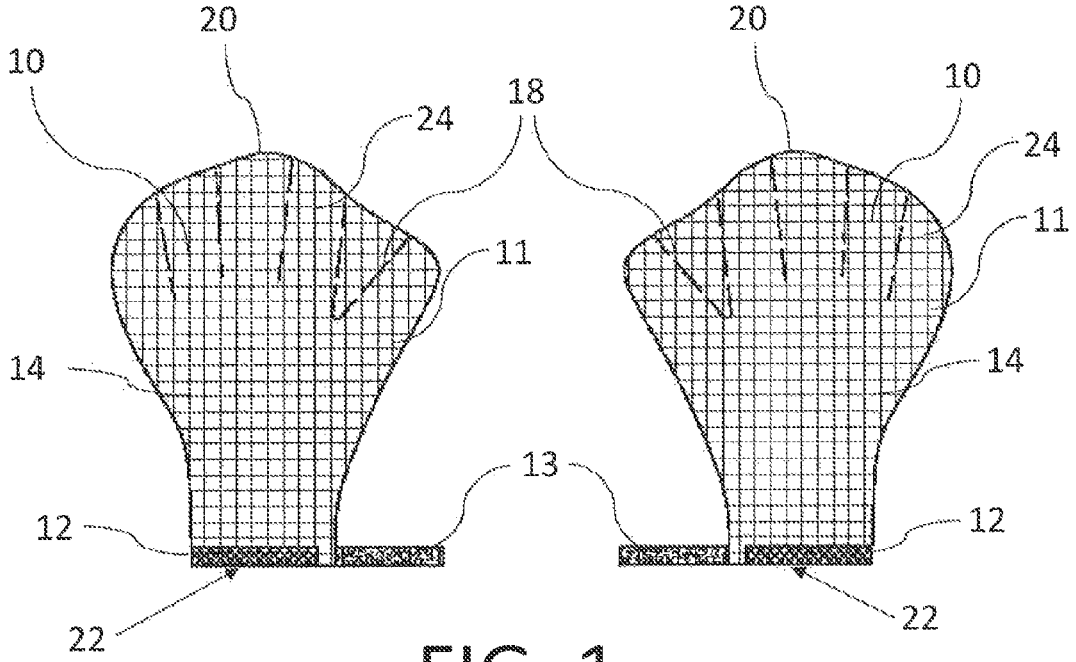
FIG. 1 is a front view of a glove with webbed fingers and a wrist strap.
Figure 2:
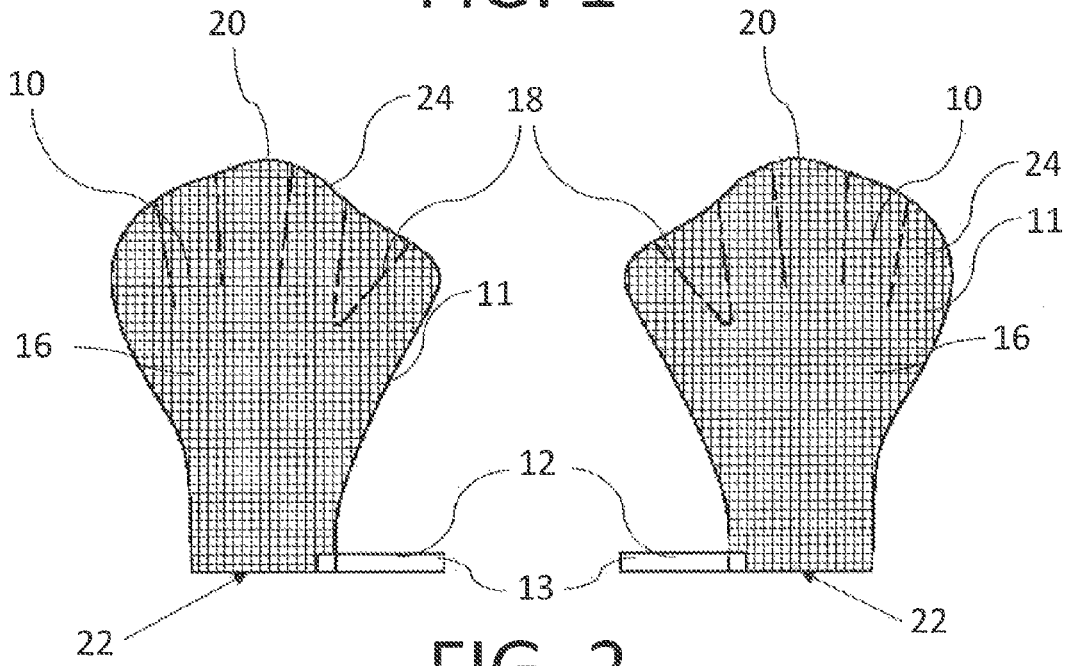
FIG. 2 is a back view of a glove with webbed fingers and a wrist strap.
Figure 3:
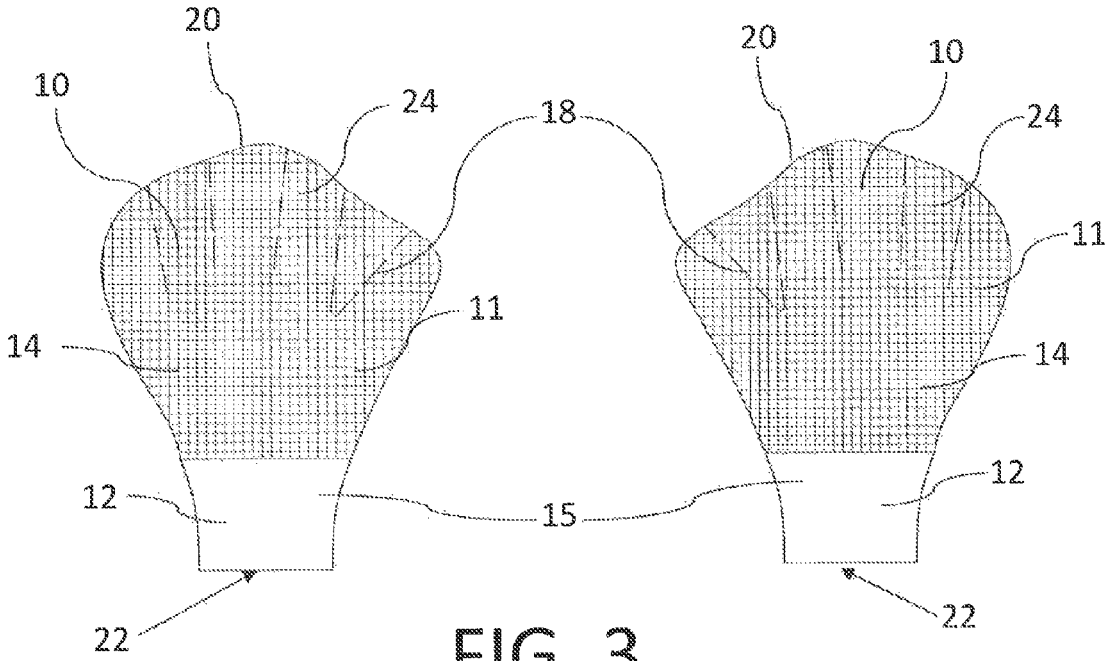
FIG. 3 is a front view of a glove with webbed fingers and a ribbed wrist.
Figure 4:
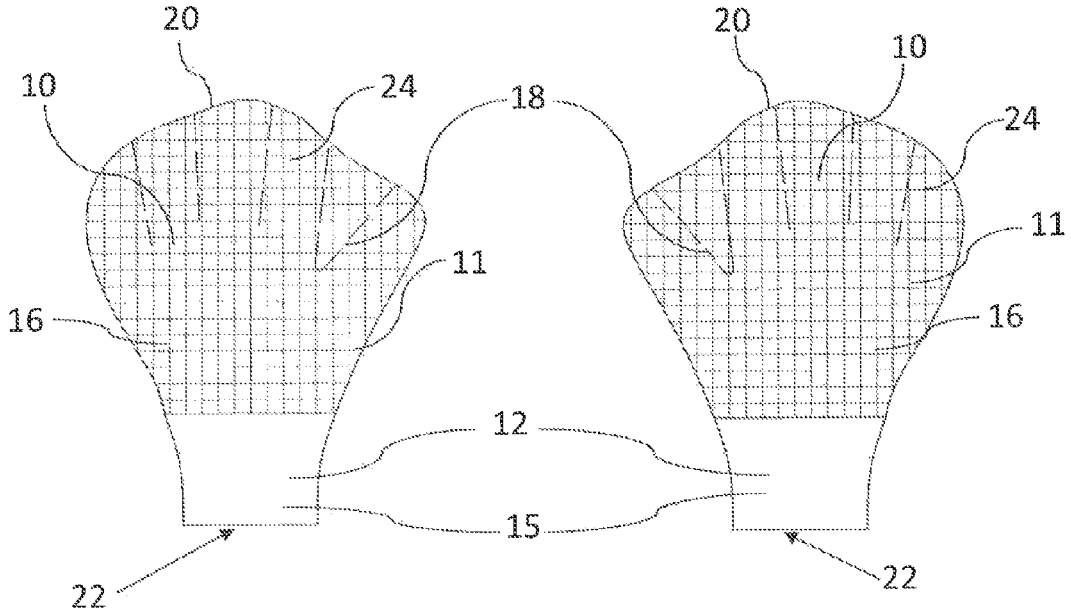
FIG. 4 is a back view of a glove with webbed fingers and a ribbed wrist.

A hand covering generally identified by reference numeral 10 will now be described with reference to FIG. 1 through 9. Although the described embodiment is used for covering the hand, it will be understood that the same principles could be applied to an article of clothing for covering another part of the body, such as the foot.

Referring to FIG. 1, hand covering 10, as shown, has a body 11 with a first side 14 with a first material and a second side 16 with a second material. The first and second materials are selected to have different permeabilities. Permeability is defined as the ability of a medium to permit flow of liquid or gas, and in this context, is defined relative to water flowing across first or second sides 14 or 16 between an outer surface of body 11 and a hand receiving cavity. The permeability of the material will determine the rate at which the water flows through the material, and therefore the amount of drag that the material experiences as it moves through the water. The amount of drag will also be affected by the amount of water that cannot pass through the material and therefore flows around the material. As drag increases or decreases, the force required by the user changes, such that the exercises can be customized or modified to an individual's needs or preferences. By providing two materials with different permeabilities, it has been found that the drag experienced by body 11 will depend on the side that lead the movement through the water. For example, if first side 14 has a material with a lower permeability than second side 16, it has been found that the drag is less when first side 14 leads the movement through water, and the drag is greater when second side 16 leads movement through water, even though the water will presumably encounter both layers of material as the user passes through the water.

Figure 5:
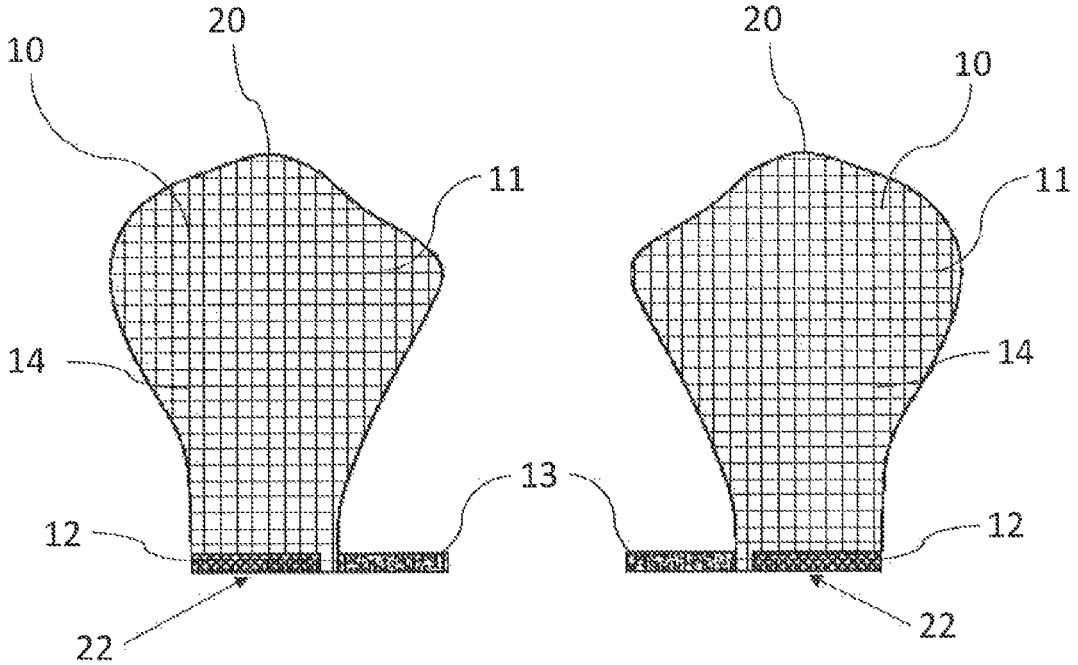
FIG. 5 is a front view of a bag with a wrist strap.
Figure 6:
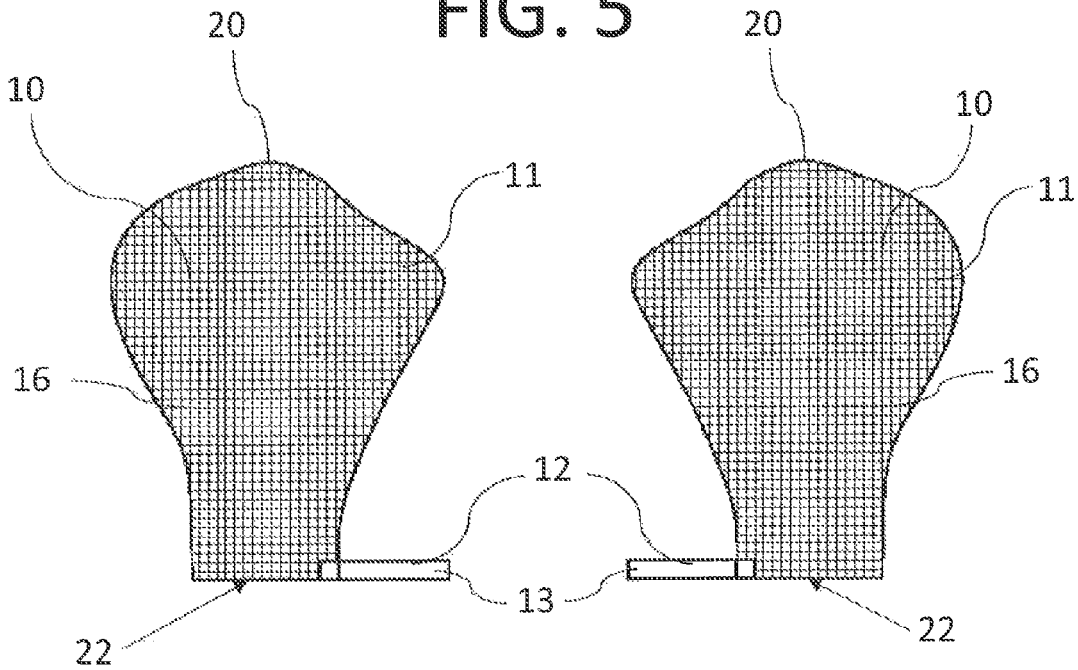
FIG. 6 is a back view of a bag with a wrist strap.
Figure 7:
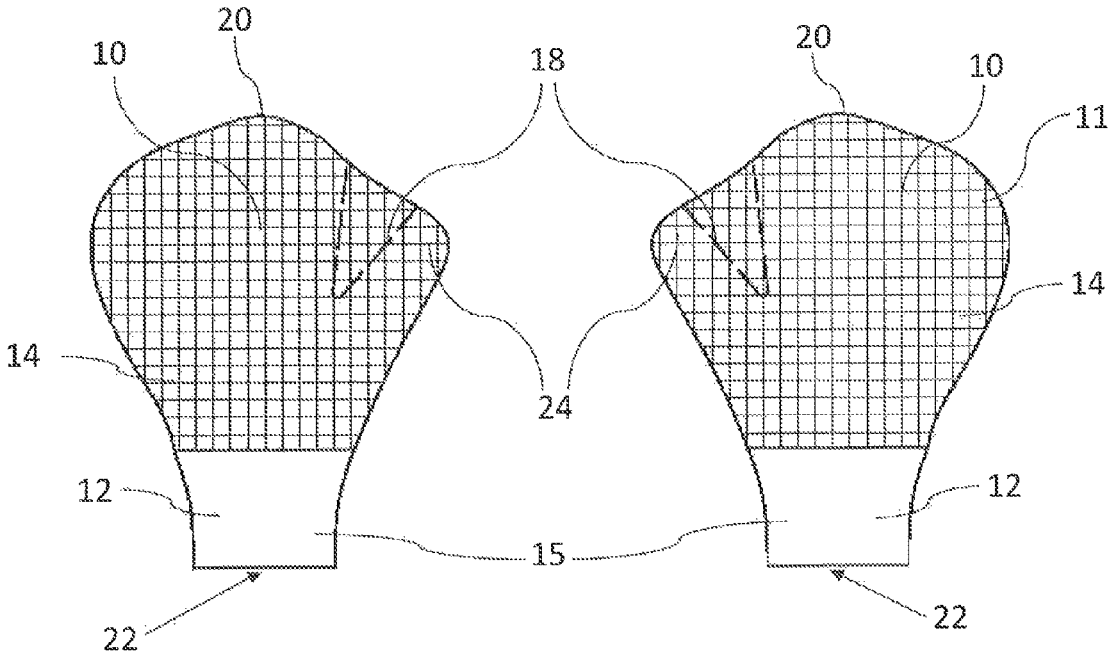
FIG. 7 is a front view of a mitt with a ribbed wrist.
Figure 8:
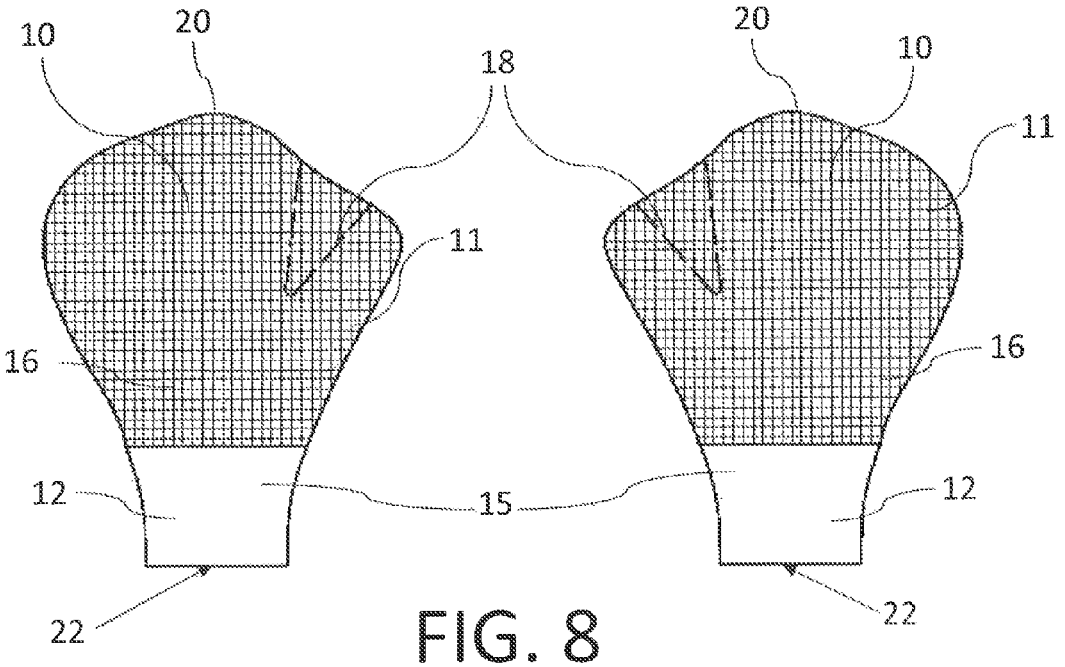
FIG. 8 is a back view of a mitt with a ribbed wrist.
Figure 9:
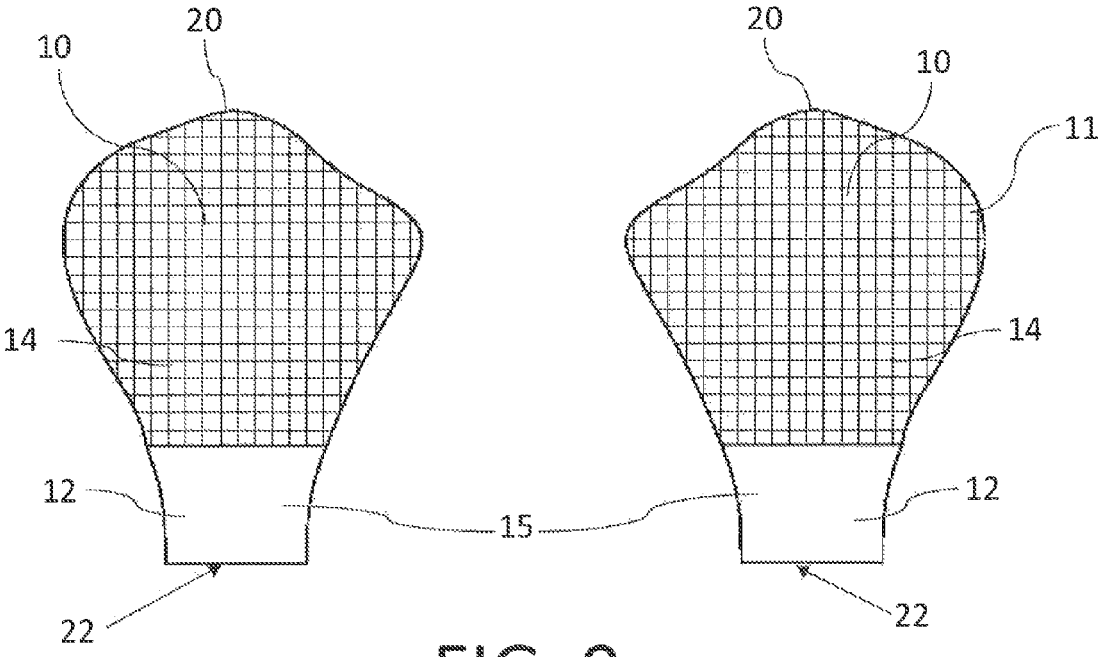
FIG. 9 is a front view of a bag with a ribbed wrist.
Figure 10:
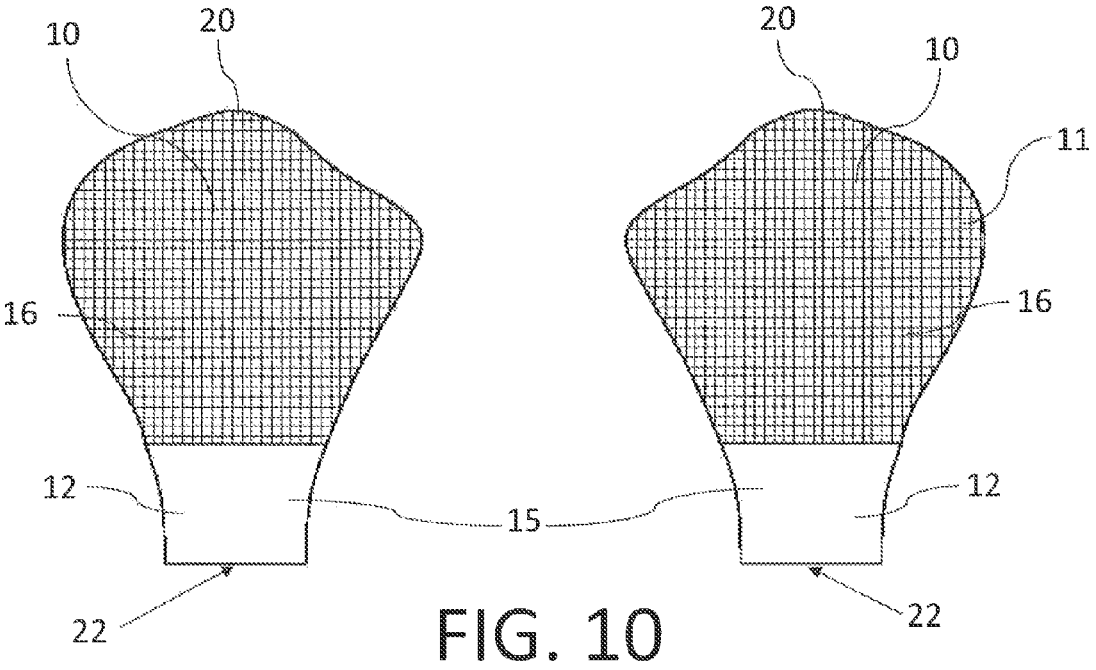
FIG. 10 is a back view of a bag with a ribbed wrist.
Figure 11:
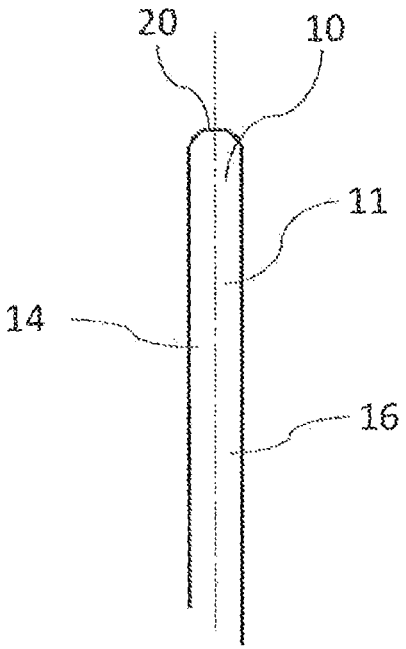
FIG. 11 is a sectional side view of the hand portion.

Body 11 of hand covering 10 is in the form of a garment worn on the hand and is generally made by attaching first and second sides 14 and 16 together along their outer edges 20 to define a hand-receiving cavity with an opening 22 at one end. Opening 22 allows the user to insert their hand into the hand receiving cavity of body 11. Hand covering 10 is sized and shaped to be worn on a left hand in a first orientation and on a right hand in a second orientation that is opposite the first orientation. Hand covering 10 may take various forms, such as a glove with webbed fingers 24 as shown in FIG. 1, FIG. 2, FIG. 3 and FIG. 4 or a single cavity similar to a bag that can be worn in the first and second orientations on either the left or right hands as shown in FIG. 5, FIG. 6, FIG. 9 and FIG. 10. Other configurations are possible, such as a mitt as shown in FIG. 7 and FIG. 8 with a thumb opening 26 only, or with one or more openings for one or more fingers (not shown). In order to create these different configurations, hand covering 10 may feature stitching 18 to separate the digits or shape body 11 in the desired design. As can be seen in FIG. 5, body 11 may still be shaped, even in the "bag" configuration, to fit the left or right hand, depending on its orientation. In the bag configuration, body 11 may be symmetric from left to right, or may be shaped to fit a left or right hand in a particular orientation. The different glove, mitt or bag design also allows the user to vary the drag based on the hand and finger position within body 11, such as by using fingers spread apart or close together. In the glove design, placing the fingers close together will bunch the body 11 more than in the bag or mitt design, while stitching 18 will provide more structure to body 11 when fingers are spread apart. It is preferred that the shape of first and second sides 14 and 16 are mirror images such that hand covering 10 can be worn in a first and second orientation. The amount of drag may also be varied based on the size of body 11 and how tightly it fits on the user. Hand covering 10 preferably covers the hand and wrist of a user, and has an attachment 12 at the wrist to prevent hand covering 10 from being unintentionally removed. Attachment 12 may be a variety of attachments as known in the art. For example, attachment 12 may be a strap 13, as shown in FIG. 1, FIG. 2, FIG. 5, and FIG. 6, preferably with a hook and loop attachment such as Velcro or another water resistant strap type attachment, such as with snaps, buttons, clips, etc. Attachment 12 may also be a ribbed or elastic cuff 15, as shown in FIG. 3, FIG. 4, FIG. 7, FIG. 8, FIG. 9 and FIG. 10. It will be understood that any wrist attachment 12 may be used with any form of hand covering 10, and possible configurations are not limited to the embodiments shown. Referring to FIG. 11, first and second sides 14 and 16 are mechanically attached along outer edges 20 of hand covering 10, such as by stitching, gluing, or during manufacture by using advanced weaving techniques. First and second sides 14 and 16 may also be modified during manufacture. This allows both sides to be made from either the same material or different materials with desired characteristics, and with one or both sides treated or modified after forming body 12 to achieve a desired permeability.

There is a wide range of possible material or fabrics that may be used to make body 11 as will be understood by those skilled in the art. While some examples are given herein, it will be understood that these are a non-exhaustive list of some design considerations that may be used in designing hand covering 10. Preferably, one or both sides 14 and 16 are made from a mesh fabric with a mesh size selected to provide the desired amount of permeability. The material is preferably durable and suitable for use in chemically treated and non-chemically treated water suitable for swimming and may be woven natural or synthetic fibres. Preferably, for ease of use, cleaning and storage, the material will not absorb or retain a significant amount of water. It is preferred that the materials chosen incorporate some elastic properties that permit ease of donning and removal for the user, or that opening 26 is designed to otherwise accommodate the user's hand. The material is preferably durable and may be either buoyant or non-buoyant.

Hand covering 10 can be worn to induce increased drag or resistance while moving arms and hands through the water. Hand covering 10 covers the hand of a user and attachment 12 secures hand covering 10. When used in water based activities, the hand is moved such that either first side 14 or second side 16 leads through the water, depending on the hand's orientation, and the orientation of hand covering 10 relative to the hand. As hand covering 10 is constructed from a permeable fabric, such as a mesh fabric, water is able to pass through the fabric of the hand covering 10. A more permeable material will allow more water to pass through, or allow water to pass through at a higher rate, as hand covering 10 passes through water. The amount of drag will also be dependent on the speed at which hand covering 10 passes through the water, however this will be understood by users and a suitable or optimal speed can be determined for that user based on their experience with hand covering 10 or by an instructor. The movement of hand covering 10 results in a drag force being generated and experienced by the user. Assuming that first side 14 has a higher permeability than second side 16, it has been found that a first induced drag is experienced when moving hand covering 10 through the water with first side 14 leading, and that a different second induced drag is experienced when moving hand covering 10 through the water with second side 16 leading. Second side 16 may be caused to lead through the water by reversing the orientation or direction of the hand or by reversing the orientation of the hand covering 10. As shown in FIG. 1-FIG. 10, the hand coverings 10 are made as mirror images, allowing the user to switch the hand coverings 10 to the opposite hand, which changes the material that is adjacent to the inside or outside of the user's hand. This allows the user to vary the resistance experienced during an activity using the same hand covering 10 without modification. When using the bag configuration, the orientation of hand covering 11 may be different on each hand, such that the user experiences more resistance with one hand than the other.

In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The scope of the following claims should not be limited by the preferred embodiments set forth in the examples above and in the drawings, but should be given the broadest interpretation consistent with the description as a whole.

What is claimed is:

1. A method of providing variable resistance to a user during water based exercises, the method comprising:

providing a hand covering for a person comprising:

a body having a first side and a second side that are attached along an outer edge to define a hand-receiving cavity and an opening in communication with the hand-receiving cavity, the hand-receiving cavity being sized and shaped to permit the body to be worn with the first side or the second side covering a palm of the user; and the first side having a first permeability and the second side having a second permeability that is different from the first permeability;

inducing a first drag by moving the hand covering through the water with the first side leading and with the first side covering the palm; and reversing the hand covering such that the second side covers the palm and inducing a second drag that is different from the first drag by moving the hand covering through the water with the second side leading.

2. The method of claim 1, wherein the shapes of the first and second sides comprise mirror images.

3. The method of claim 2, wherein moving the gloves to the opposite hands results in reversing the orientations of the gloves and switches the induced drag.

4. The method of claim 1, wherein the hand covering is a bag that can be worn in the first and second orientations on each of the left and right hands.

5. The method of claim 1, wherein the hand covering is a mitt.

6. The method of claim 1, wherein the hand covering is a glove comprising webbed fingers.

7. The method of claim 1, wherein at least one of the first side and the second side comprises a mesh fabric.

8. The method of claim 1, wherein providing a hand covering comprises providing a first hand covering on a right hand and a second hand covering on a left hand, wherein the first hand covering has the first side covering the palm and the second hand covering has the second side covering the palm.

* * * * *